US009538848B2

(12) United States Patent
Plikat et al.

(10) Patent No.: US 9,538,848 B2
(45) Date of Patent: Jan. 10, 2017

(54) PIECE OF SEATING FURNITURE HAVING A SADDLE-FORM SEAT SURFACE

(71) Applicants: Johann Burkhard Schmitz, Berlin (DE); Carola E. M. Zwick, Berlin (DE); Roland R. O. Zwick, Berlin (DE)

(72) Inventors: Claudia Plikat, Berlin (DE); Johann Burkhard Schmitz, Berlin (DE); Carola E. M. Zwick, Berlin (DE); Roland R. O. Zwick, Berlin (DE)

(73) Assignees: Johann Burkhard Schmitz, Berlin (DE); Carola Zwick, Berlin (DE); Roland Zwick, Berlin (DE)

( * ) Notice: Subject to any disclaimer, the term of this patent is extended or adjusted under 35 U.S.C. 154(b) by 5 days.

(21) Appl. No.: 14/355,162

(22) PCT Filed: Oct. 30, 2012

(86) PCT No.: PCT/EP2012/004535
§ 371 (c)(1),
(2) Date: Apr. 29, 2014

(87) PCT Pub. No.: WO2013/064239
PCT Pub. Date: May 10, 2013

(65) Prior Publication Data

US 2015/0102642 A1 Apr. 16, 2015

(30) Foreign Application Priority Data

Oct. 31, 2011 (DE) ..... 10 2011 117 285

(51) Int. Cl.
*A47C 7/02* (2006.01)
*A47C 9/02* (2006.01)

(52) U.S. Cl.
CPC *A47C 7/022* (2013.01); *A47C 9/02* (2013.01)

(58) Field of Classification Search
CPC ..... A47C 9/005; A47C 9/025; A47C 9/02; A47C 7/022
(Continued)

(56) References Cited

U.S. PATENT DOCUMENTS 1,111,586 A * 9/1914 Hurlbert ..... A47C 9/00 108/41
1,620,448 A * 3/1927 Dourdoufis ..... A47C 7/503 248/430
(Continued)

FOREIGN PATENT DOCUMENTS

CN 2137900 7/1993
CN 2206579 9/1995
(Continued)

OTHER PUBLICATIONS

Office Action from the Intellectual Property Office of the People's Republic of China for Application No. 20128005355.2 dated Nov. 25, 2015 (9 pages).
(Continued)

*Primary Examiner* — Milton Nelson, Jr.
(74) *Attorney, Agent, or Firm* — Michael Best & Friedrich LLP

(57) ABSTRACT

A piece of seating furniture has a saddle-form seat surface, wherein the seat surface is arranged on a saddle support. The seat surface here is mounted between a front saddle member on a front member support and a rear saddle member on a rear member support.

15 Claims, 13 Drawing Sheets

(58) Field of Classification Search
USPC ..... 297/4, 452.64, 204, 195.11, 452.56, 461
See application file for complete search history.

(56) References Cited

U.S. PATENT DOCUMENTS

| | | | | |
|---|---|---|---|---|
| 2,871,014 | A * | 1/1959 | Haskell | A63G 17/00 297/195.11 |
| 3,541,313 | A * | 11/1970 | Buzzi | A47C 7/503 297/195.11 |
| 4,366,981 | A | 1/1983 | Ziegler et al. | |
| 4,469,372 | A * | 9/1984 | Long | A47C 9/002 248/188.7 |
| 7,401,850 | B2 * | 7/2008 | Micheel | A47C 9/105 108/118 |
| 2002/0167206 | A1 | 11/2002 | Jalkanen | |
| 2003/0001424 | A1 * | 1/2003 | Mundell | A47C 7/16 297/452.56 |
| 2004/0124689 | A1 * | 7/2004 | Numa | A47C 7/282 297/452.56 |
| 2005/0088029 | A1 * | 4/2005 | Stokes | A47C 9/022 297/461 |

FOREIGN PATENT DOCUMENTS

| | | |
|---|---|---|
| CN | 1278419 | 1/2001 |
| CN | 101305869 | 11/2008 |
| EP | 2172135 A1 | 4/2010 |
| FR | 2868923 A1 | 10/2005 |
| WO | 0078595 A1 | 12/2000 |

OTHER PUBLICATIONS

International Preliminary Report on Patentability issued in corresponding PCT Patent Application No. PCT/EP2012/004535, mailed May 15, 2014, 9 pages.

* cited by examiner

PIECE OF SEATING FURNITURE HAVING A SADDLE-FORM SEAT SURFACE

BACKGROUND

The requirements which have to be met by pieces of seating furniture, in particular by office furniture, have increased constantly in the past. Of predominant importance in a large number of embodiments, in particular, are comfort-related requirements in combination with ergonomic aspects. Sitting in a manner which is kind to the back is just as important here as providing a flexible and compact piece of seating furniture which has a stable stand and provides a high level of flexibility for adjusting comfort-related parameters.

DE 1 032 492 B discloses an office stool having a mobile, three-legged base framework and a height-adjustable saddle seat.

Pieces of seating furniture have a saddle-form seat surface, wherein the seat surface is arranged on a saddle support. The seat surface is mounted between a front saddle member on a front member support and a rear saddle member on a rear member support. A saddle surface provides an anatomically comfortable way of sitting for the user. In the present embodiment of the piece of seating furniture, the surface is designed to be larger than a conventional saddle, for example of a standing seat or of a bicycle, such that support is given to the entire region of the user's bottom. This avoids the unpleasant situation where the seat leaves its impression on the user. Furthermore, it is also possible for the user's back to be positioned in the healthy S shape, since dynamic sitting, as on a sitting ball, is possible.

In one embodiment, the seat surface is formed as a minimal surface by way of a covering, which is mounted between the saddle members. This further improves the adaptation to the anatomy of the user's bottom and increases the sitting comfort. Minimal surfaces always constitute optimum uniformity of the surface progression while avoiding edge locations.

In one embodiment, the covering, by means of which the seat surface is formed, is connected to the front saddle member between a first end of the front saddle member and a second end of the front saddle member, in particular in a continuous and opening-free manner to the front saddle member along a first fastening region and also for the covering, by means of which the seat surface is formed, to be connected to the rear saddle member between a first end of the rear saddle member and a second end of the rear saddle member, in a continuous and opening-free manner to the rear saddle member along a second fastening region. This achieves optimum attachment of the seat surface or of the covering, which forms the seat surface, to the front and the rear saddle members, and it is therefore possible for the seat surface also to be made from highly flexible and/or thin materials such as woven fabrics or sheet materials, since these are retained in an opening-free manner in the region of the saddle members. It is thus, in particular, possible for the tensile stressing, which constitutes a significant factor for the load-bearing capability of thin coverings, to be transmitted uniformly to the covering and for tearing of the covering, which is more likely as a result of peaks in stressing, to be avoided. The invention provides for the covering to be clamped in at the saddle members and possibly, in addition, to be adhesively bonded and/or welded thereto or for the covering to be folded over around the front saddle member and/or around the rear saddle member and possibly, in addition, to be adhesively bonded and/or welded thereto.

A further embodiment is distinguished in that the seat surface is designed to be fixed at the saddle members and flexible between the saddle members, in particular at connecting edges 9. The connecting edges here are located in those parts of an all-round peripheral region of the seat surface where the seat surface runs between the front saddle member and the rear saddle member. This allows optimum connection to the saddle members. When the piece of seating furniture according to the invention is being used for sitting on, the user's legs usually bear against the side edges or connecting edges of the seat surface. The flexible configuration here means that there are no pressure points established.

A further embodiment of the piece of seating furniture has the seat surface mounted in a self-supporting manner between the saddle members. The avoidance of supporting structures beneath the seat surface further improves the seating comfort, since it is not possible for any pressure points to be established and the seat surface adapts itself in a fully flexible manner.

The seat surface may be defined by a woven mesh fabric which allows good ventilation and, in particular in summer, provides for a pleasant sitting experience. The covering thus has breathable properties, and therefore body heat given off by the user's body can be expelled in optimum fashion through the covering. It is also possible for a woven mesh fabric to be made to meet requirements in optimum fashion as a result of the type of weaving used and/or as a result of the properties of the weaving thread.

The first fastening region may follow a curved, convex progression of the front saddle member, wherein the first fastening region has a first length, and for the second fastening region to follow a curved, convex progression of the rear saddle member, wherein the second fastening region has a second length L6. As a result of the two convexly running saddle members, the saddle surface, which is mounted between the saddle members, is formed as a saddle surface which is curved convexly in the direction of the user's bottom, and it assumes an ergonomically advantageous shape similar to a riding saddle.

The covering may be configured with a thickness of not more than 3 mm and in particular with a thickness of not more than 2 mm. Such coverings are available cost-effectively in a wide variety of different embodiments and, in particular, can readily realize a breathable design. Such dimensioning of the covering straightforwardly ensures the necessary level of flexibility of the covering, and therefore the covering can readily follow the flexing of the front and rear saddle members.

In a further expedient embodiment, it is provided that the front saddle member on the front member support and the rear saddle member on the rear member support are designed such that they can be displaced relative to one another, in particular such that the distance between the two can be changed via a tensioning device. If the tensioning device comprises a spindle and a hand wheel, it is then possible, by virtue of the spindle being rotated by its hand wheel, to increase a distance between the two member-support portions, and thus tension the covering, or to decrease said distance, and thus reduce tensioning of the covering. The tensioning and thus the hardness of the seat surface can be adjusted as a result, and therefore said seat surface can be adapted to the individual comfort-related requirements and user-related parameters, for example body weight and sitting position.

A further-expedient configuration of the piece of seating furniture is configured with the front saddle member and the rear saddle member having, at each of their ends, a spiral turn, in which the seat surface is mounted, in particular by winding, wherein, between the saddle members, the peripheral region of the seat surface is guided in a wound manner preferably around a covering guide. Mounting the covering, which forms the seat surface, by "winding" provides a stable, tear-proof edge without it being necessary to introduce additional edge reinforcements, which reduce, for example, the flexibility. It is conceivable to fold in a flat material to provide a certain amount of guidance and dimensional stability for the wound region. At the ends of the members, the material which forms the seat surface is provided, by the spiral turn, with an advantageous guide, which is favorable for loading purposes, since edges are avoided. This makes it possible to realize a high level of material tensioning without particular reinforcements having to be carried out.

In general terms, in particular the use of point-elastic woven mesh material as the covering material creates an advantageous seat-surface embodiment which provides a high level of comfort, while advantageous stability is provided at the same time, when it is subjected, for example, to point loading by the contents of back pockets (e.g. a set of keys).

An expedient embodiment of the piece of seating furniture has the saddle support arranged on a rolling framework, wherein the rolling framework has, in particular, a front extension arm, with a front roller, and two rear extension arms, with rear rollers, and the angle $\alpha 1$ of, in particular, greater than 120° is formed between the front extension arm and rear extension arm. Arranging the saddle support and a seat unit, which comprises the seat surface, the saddle members and the member supports, on the rolling framework makes it possible for the piece of seating furniture to be used as a mobile workstation for project meetings and team work or to provide a high level of freedom of movement at a desk. Furthermore, the saddle support may be designed as a telescopic support which allows height adjustment of the seat unit in relation to an underlying surface. A telescopic support provided is also one, in particular, which even allows adjustment from a piece of seating furniture to a piece of sit stand furniture. The possibility of configuring the front roller and/or one or both of the rear rollers as arrestable rollers also provides for improved use as a piece of sit stand furniture.

A further expedient embodiment is configured with the seat surface defined at a front portion, by way of the front saddle member, with a height h4 and a width b4 and at a rear portion, by way of the rear saddle member, with a height h6 and a width b6, where preferably h4>h6 and b6>b4. The widths of the saddle members are measured horizontally in space and at right angles to a longitudinal axis L1 of the piece of seating furniture, said axis being defined by the front member support and being located horizontally in space. Observing the aforementioned dimensional relationships gives the seat surface a three-dimensional shape which meets the basic anatomical requirements. In principle, the highest point HP4 of the front saddle member has a difference in height H46, as measured vertically in space, in relation to the highest point HP6 of the rear saddle member, wherein the highest point HP4 of the front saddle member is located at a higher level than the highest point HP6 of the rear saddle member. The corresponding saddle geometry, which gives an advantageous seat-surface shape, promotes well-being and makes it possible for a user to sit on the piece of seating furniture for prolonged periods without feeling fatigue. The posture and body position here are made to adopt preferably a lordosis shape, with forwardly inclined curvature or an S shape, so that healthy sitting is made possible.

A further advantageous embodiment of the piece of seating furniture has the progression of the member supports corresponding, as seen in vertical projection, essentially to the progression of the extension arms. Basing the progression of the member supports on the progression of the rolling framework, and essentially on the progression of the saddle shape of the seat surface, ensures a high level of positional stability since the supports and extension arms provide support along the tilting axes of the seat surface.

Provision is also made for the front member support and the rear member support to form a carrier, a saddle here comprising the carrier, the front saddle member, the rear saddle member and the seat surface, which is formed as a covering, wherein the front saddle member is arranged at a front end of the carrier, wherein the rear saddle member is arranged at rear ends of the carrier, wherein the front saddle member and the rear saddle member are spaced apart from one another such that they are located opposite one another with no contact, wherein the covering is fastened on the oppositely located saddle members such that the covering, subjected to tensile stressing, forms the seat surface, wherein the seat surface is curved convexly in the direction of a user's bottom, wherein the covering is elastically expansible and designed, and tensioned, such that it is suitable, when subjected to elastic deformation as a seat surface, to carry the user. A piece of seating furniture designed in this way provides a high level of comfort and is flexible to use.

Finally, provision is made for the length of the first fastening region to be equal to the length of the second fastening region and for the covering, by means of which the seat surface is formed, in a state in which it rests in planar fashion on a planar surface, to be configured in the form of a rectangle, this creating a seat surface or covering which can be fastened on the two carrying members with comparable levels of pretensioning.

As an alternative, provision is made for the length of the first fastening region to be dimensioned to be greater than the length of the second fastening region, and not more than 1.5 times the length of the second fastening region, and for the seat surface, in a state in which it rests in planar fashion on a planar surface, to be configured in the form of a rectangle or of a trapezoid, this creating specific seat shapes in which the length of the fastening region of the front saddle member is longer than the length of the fastening region of the rear saddle member. As an alternative, provision is also made for the length of the second fastening region to be dimensioned to be greater than the the length of the first fastening region, and not more than 1.5 times the length of the first fastening region, and for the seat surface, in a state in which it rests in planar fashion on a planar surface, to be configured in the form of a rectangle or of a trapezoid, this creating specific seat shapes in which the length of the fastening region of the front saddle member is shorter than the length of the fastening region of the rear saddle member.

Finally, the pretensioning of the covering may be adjustable, so that the extent of elastic deformation of the covering can be adjusted to the individual requirements of a user and/or adaptation to the respective weight of a user can be effected. It is also thus possible to counteract a reduction in the tensioning as a result of material aging and/or a reduction or increase in the tensioning as a result of a change in temperature, and to establish the desired state of tensioning with minimal outlay.

The foregoing paragraphs have been provided by way of general introduction, and are not intended to limit the scope of the following claims. The various preferred embodiments, together wit further advantages, will be best understood by reference to the following detailed description taken in conjunction with the accompanying drawings.

DETAILED DESCRIPTION OF THE DRAWINGS AND THE PRESENTLY PREFERRED EMBODIMENTS

Figure 1:
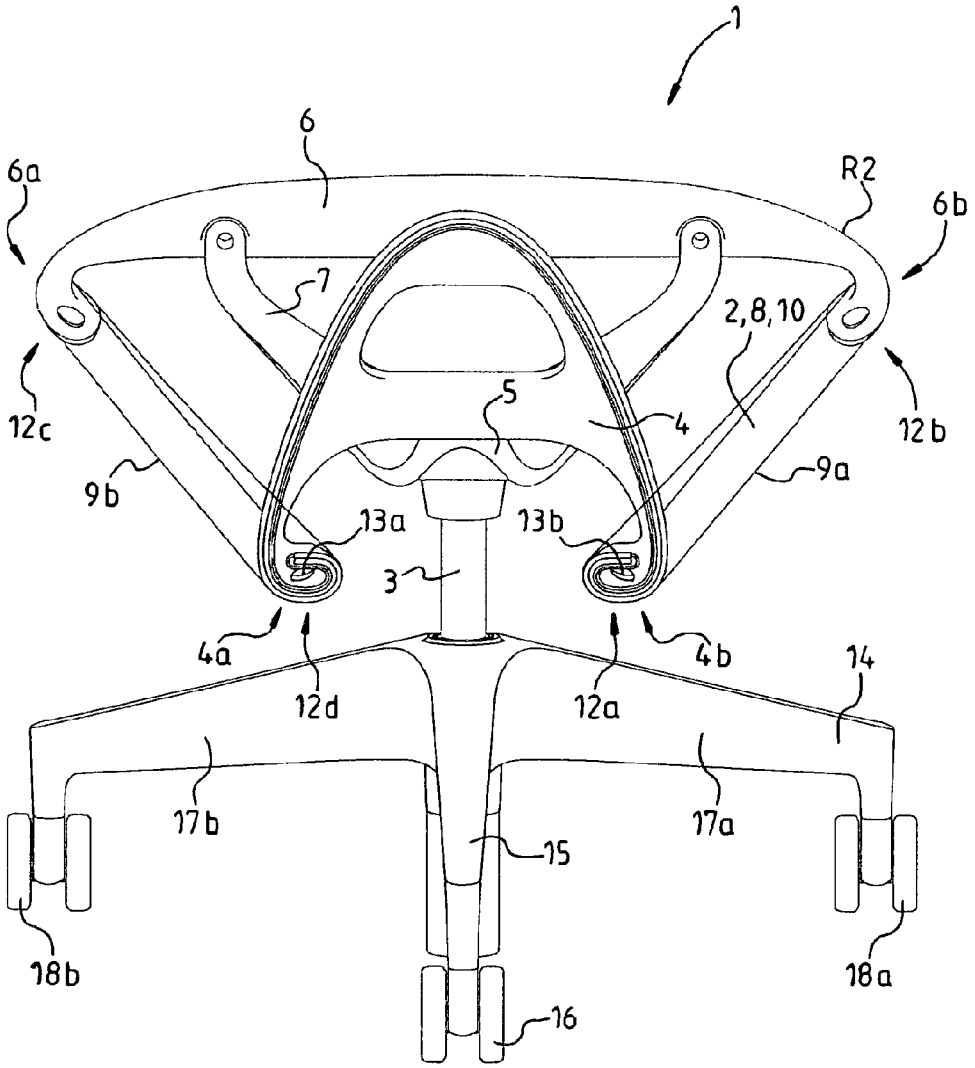
FIG. 1 shows a front view of a piece of seating furniture according to the invention.
Figure 2:
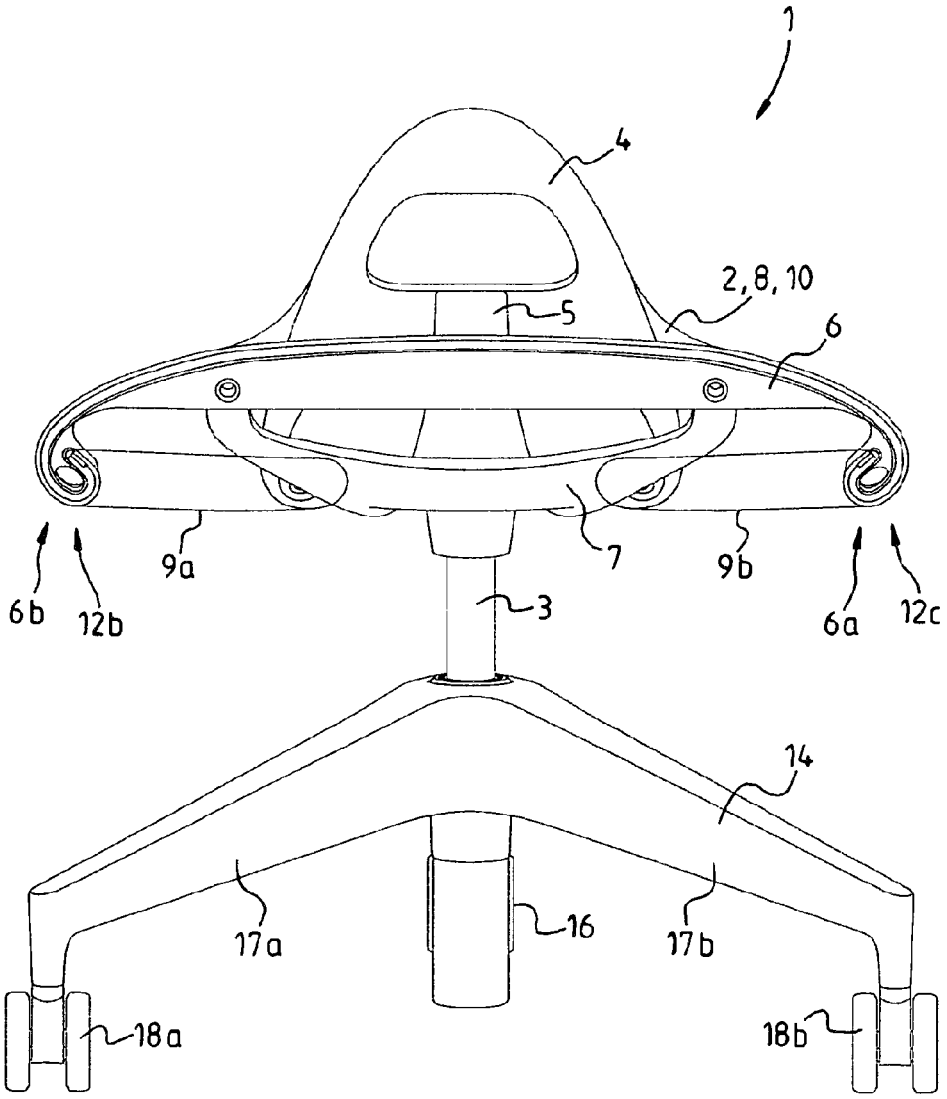
FIG. 2 shows a rear view of the piece of seating furniture shown in FIG. 1.
Figure 3:
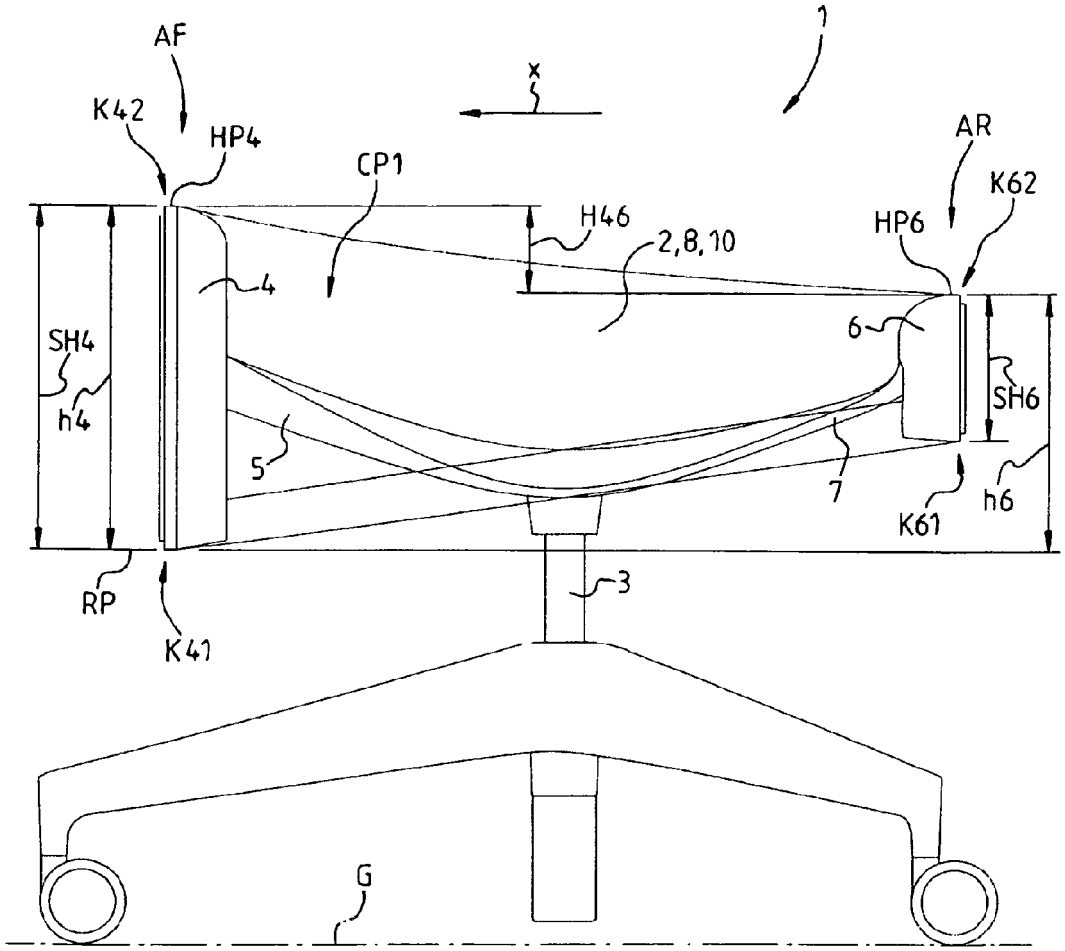
FIG. 3 shows a right-hand-side view of the piece of seating furniture shown in FIG. 1.
Figure 4:
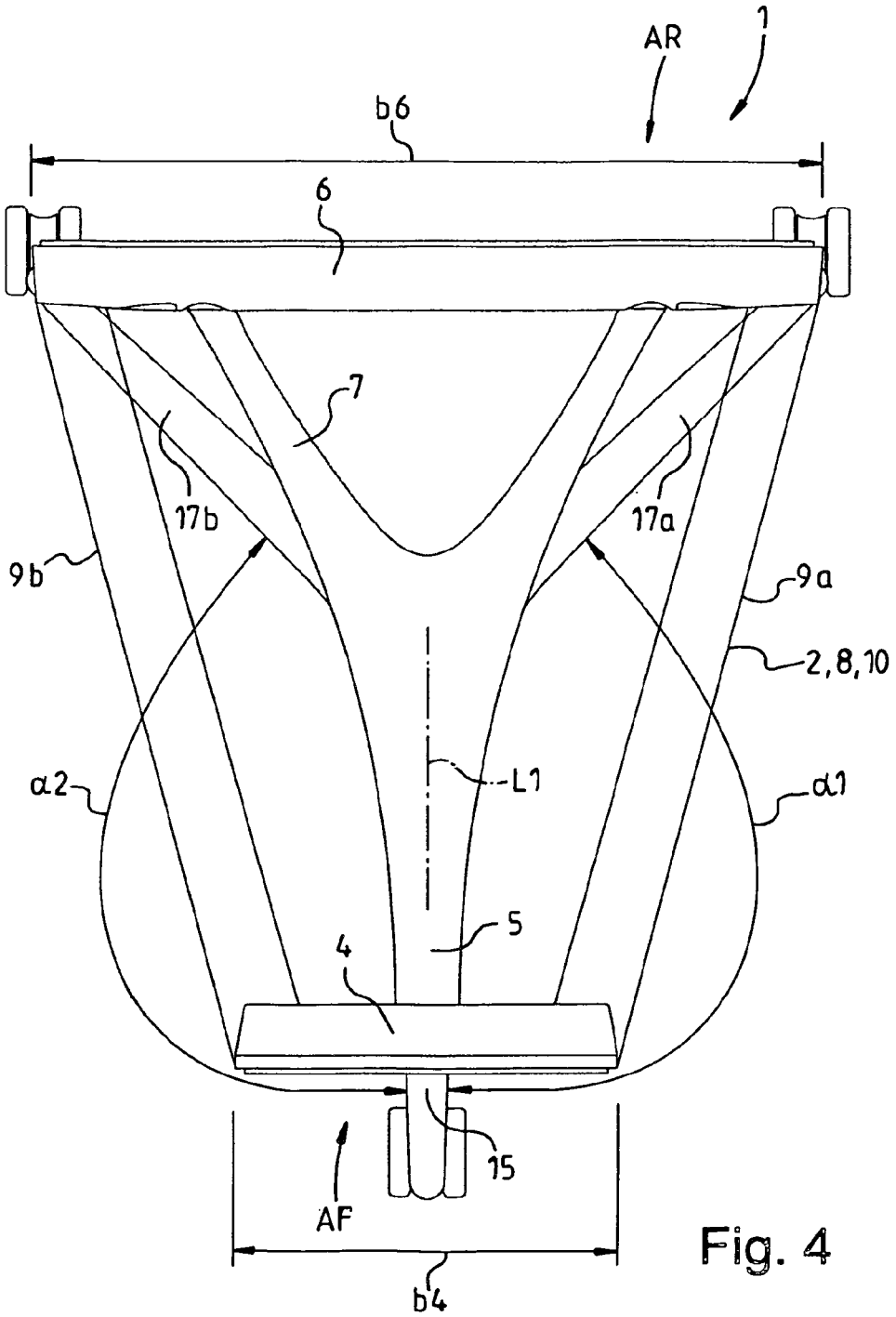
FIG. 4 shows a plan view of a seat surface of the piece of seating furniture shown in FIG. 1.
Figure 5:
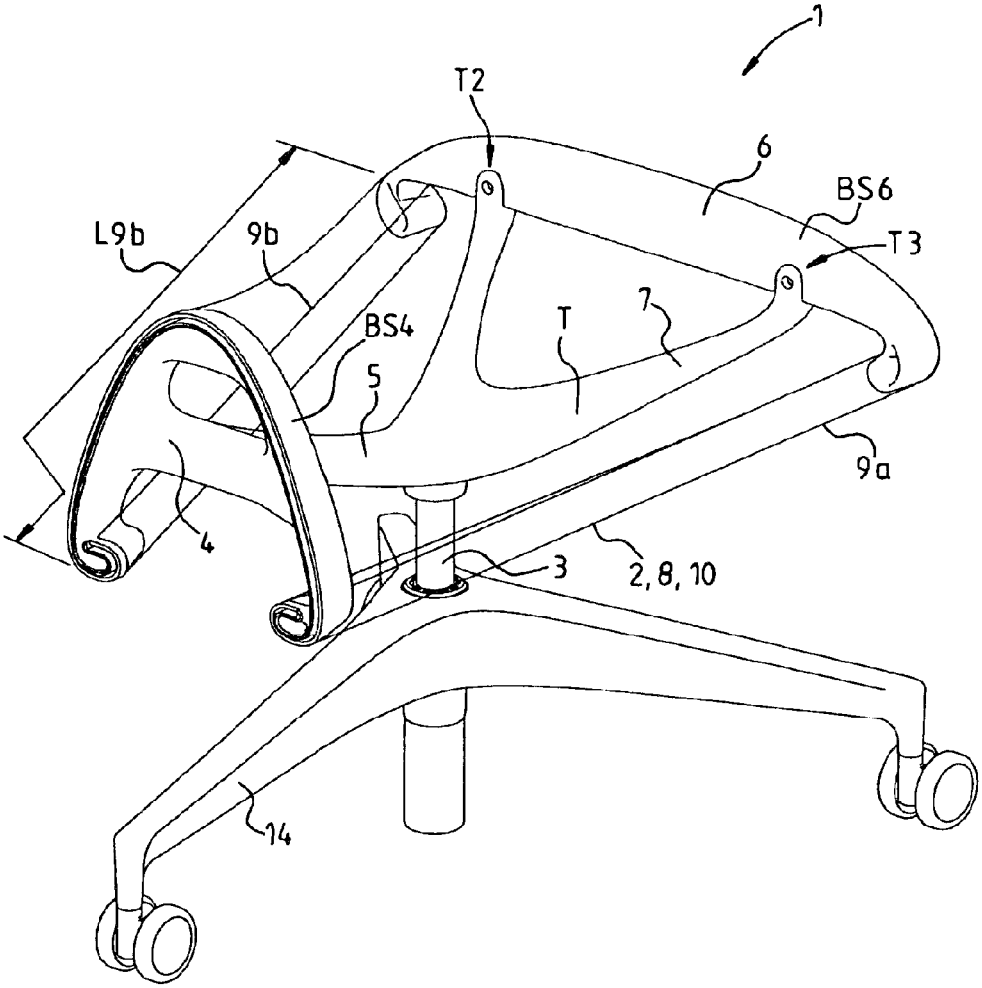
FIG. 5 shows a perspective view of the piece of seating furniture shown in FIG. 1.
Figure 6:
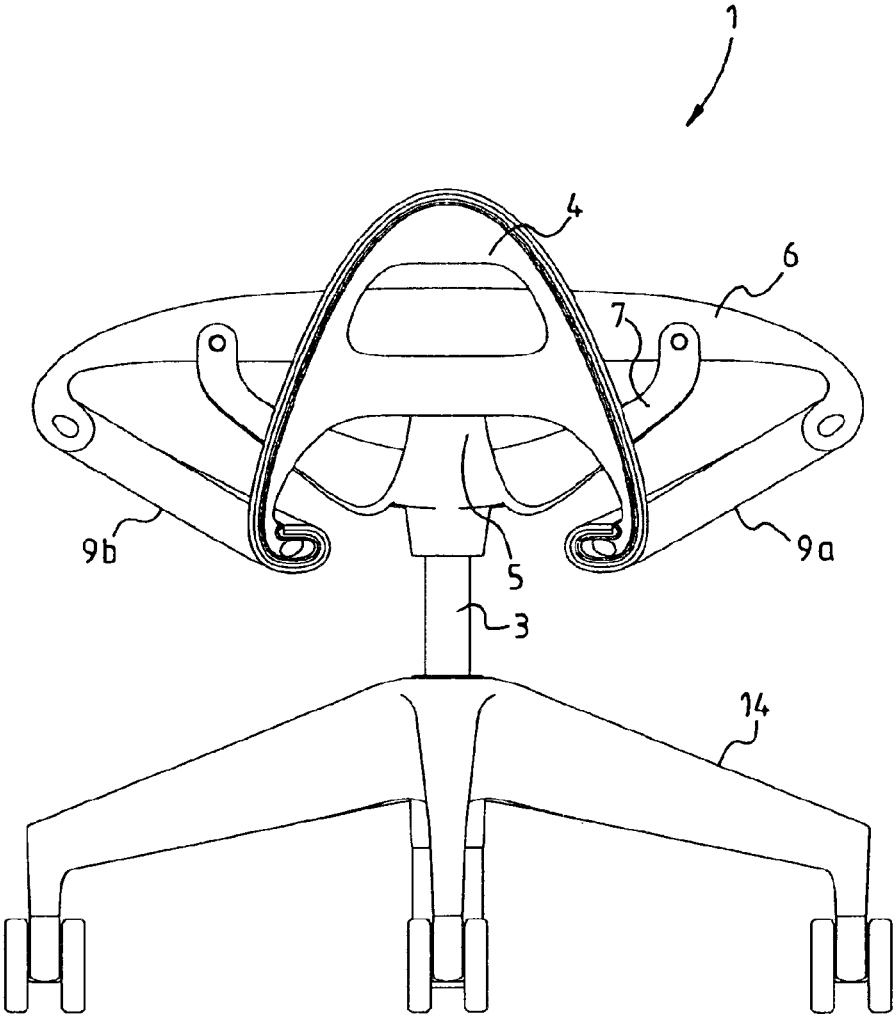
FIG. 6 shows a further front view of the piece of seating furniture shown in FIG. 1.
Figure 8:
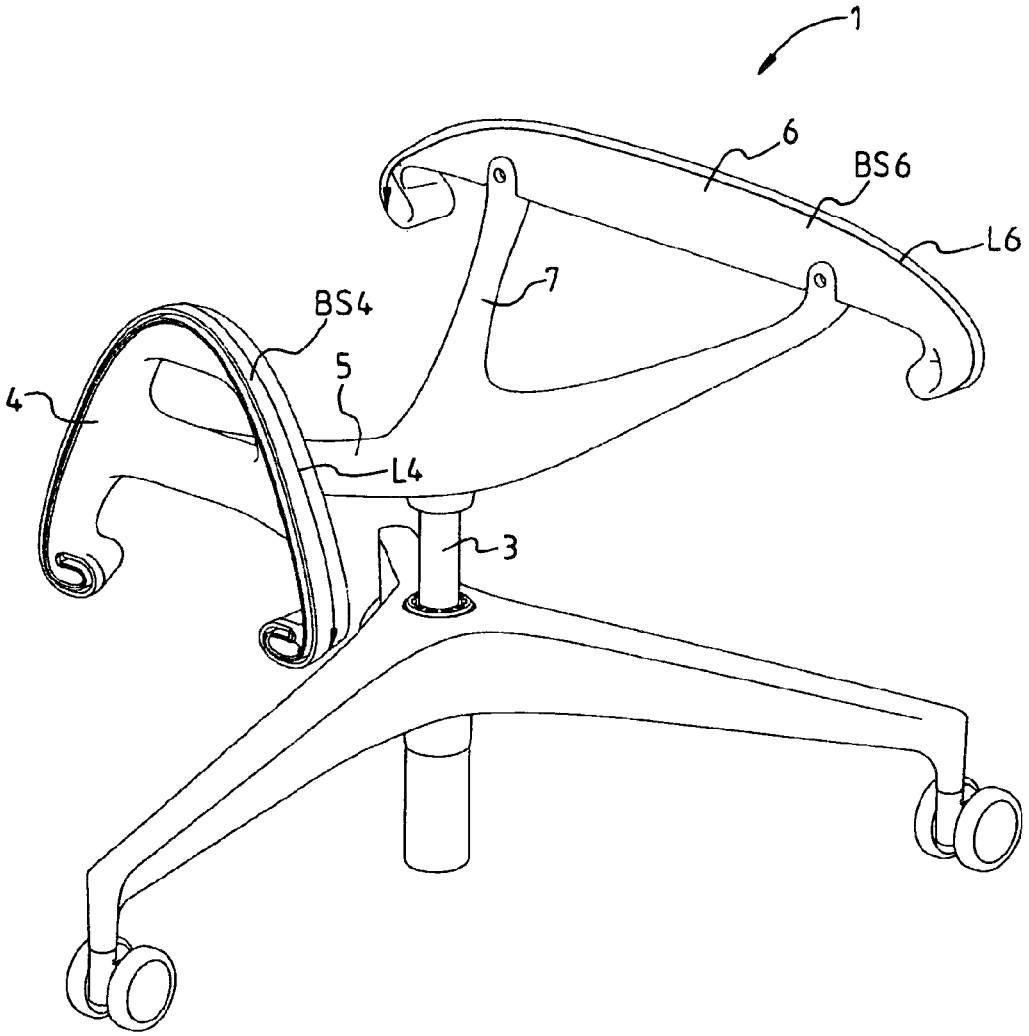
FIG. 8 shows the illustration from FIG. 7 without the seat surface.
Figure 9:
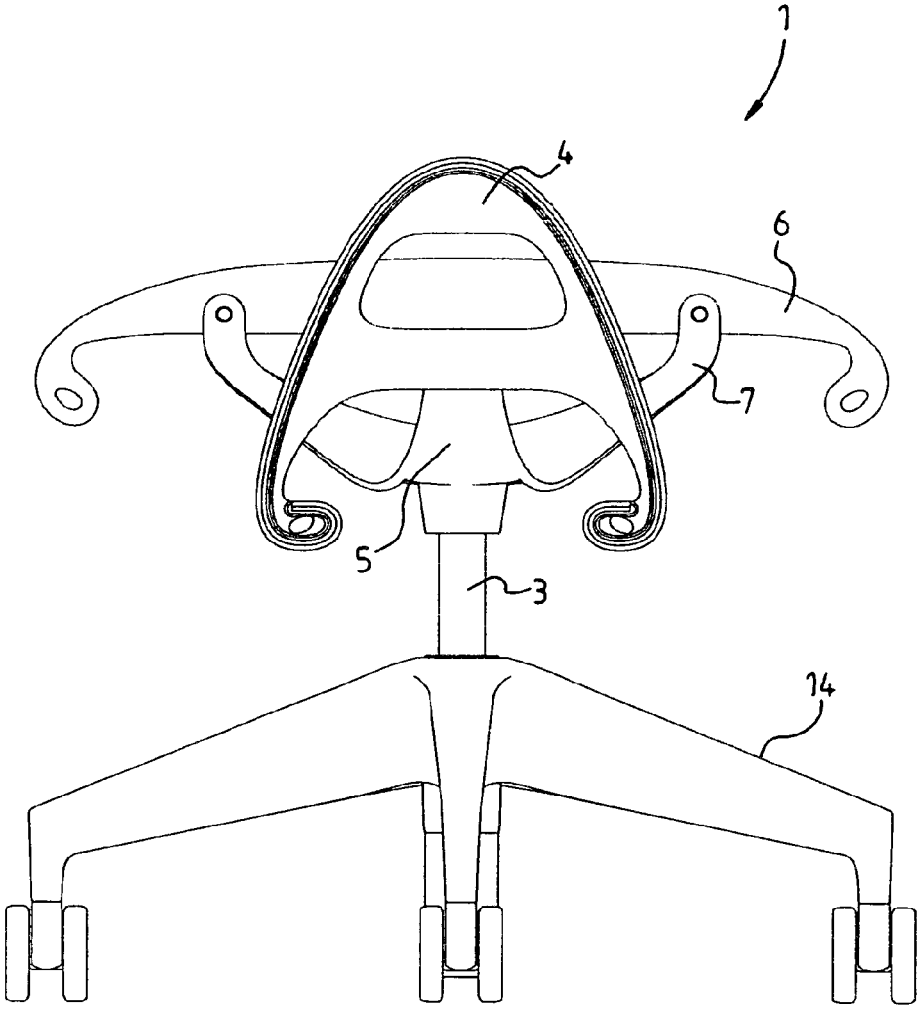
FIG. 9 shows the illustration from FIG. 6 without the seat surface.
Figure 10:
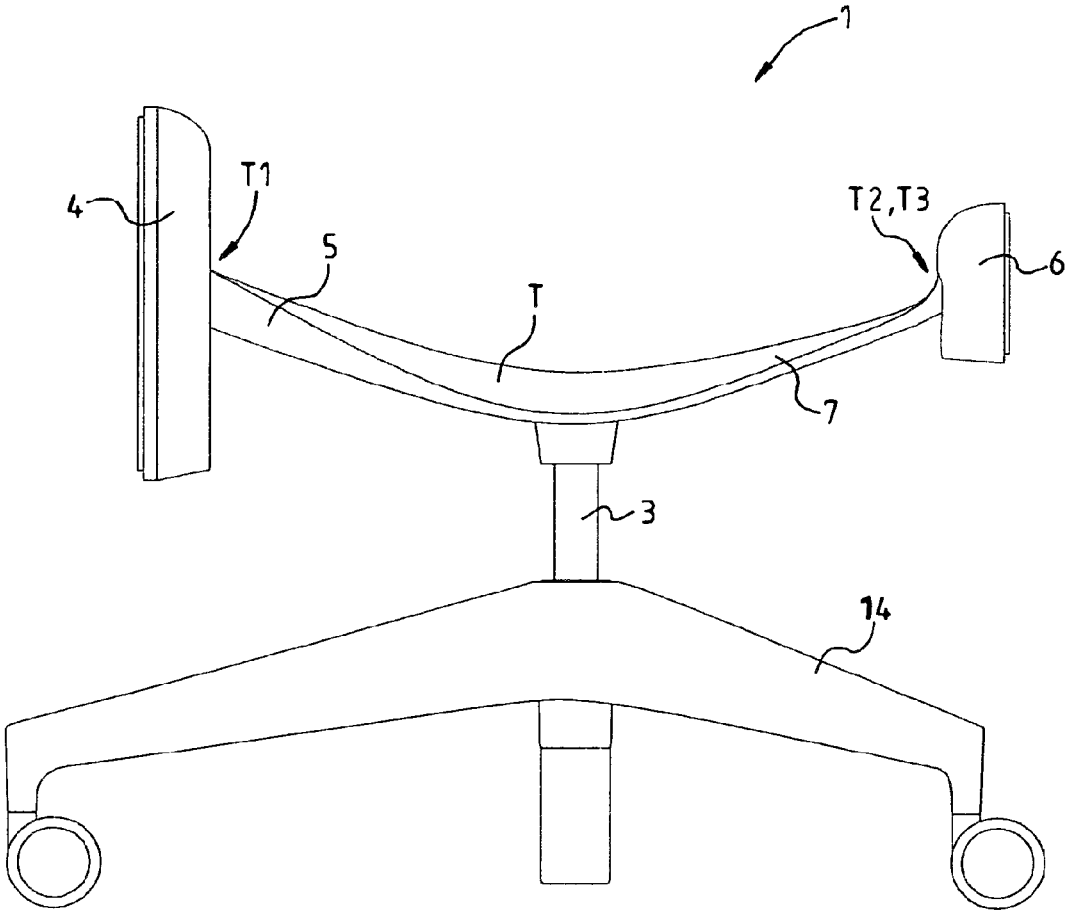
FIG. 10 shows the illustration from FIG. 3 without the seat surface.

Referring to FIGS. 1 to 6, a piece of seating furniture 1 has a saddle-form seat surface 2, wherein the seat surface 2 is arranged on a saddle support 3. FIG. 1 shows a front view of the piece of seating furniture 1, FIG. 2 shows a left-hand-side view of the piece of seating furniture 1, FIG. 3 shows a rear view of the piece of seating furniture 1, FIG. 4 shows the piece of seating furniture 1 from above, FIG. 5 shows a perspective view of the piece of seating furniture 1, and FIG. 6 shows a further front view of the piece of seating furniture 1, wherein the front view of the piece of seating furniture 1 is directed obliquely from beneath. The seat surface 2 here is mounted between a front saddle member 4, which is retained on a front member support 5, and a rear saddle member 6, which is retained on a rear member support 7. FIGS. 1 to 4 each show only edges of the seat surface 2. Between the edges, the seat surface 2 is illustrated as a transparent surface, and it is therefore also possible to see the components which are located beneath the seat surface 2 and/or are concealed by the seat surface 2. In order to clarify the progression of the seat surface 2 or of the covering 8, the illustration of FIG. 5, which shows a perspective view of the piece of seating furniture 1, is shown once again in FIG. 7 in a state in which the seat surface 2 or the covering 8 is illustrated schematically as a coarse mesh, and this makes it possible to see the progression of the seat surface 2 in space from the lines of the mesh. In order to further clarify the construction of the piece of seating furniture 1, FIGS. 8, 9 and 10 show the latter once again in a perspective view, a front view and a side view, any illustration of the seat surface having been dispensed with altogether in said figures.

The seat surface 2 or the covering 8, which forms the seat surface 2, is designed to be fixed at the saddle members 4, 6 by an adhesive-bonding connection and/or clamping connection and flexible between the saddle members 4, 6, at connecting edges 9*a*, 9*b*. The connecting edges 9*a*, 9*b* here are located in those parts of an all-round peripheral region R2 of the seat surface 2 where the seat surface 2 runs between the front saddle member 4 and the rear saddle member 6. It can be seen from the plan view of FIG. 4 that the connecting edges 9*a*, 9*b* have a rectilinear progression and run toward one another.

The seat surface 2 or the covering 8 is preferably formed by a woven mesh fabric 10 which is elastically expansible and is air-permeable between an upper side 10*a* and an underside 10*b*.

As can be seen, in particular, from FIGS. 1 and 2, the ends 4*a* and 4*b* of the front saddle member 4 and the ends 6*a* and 6*b* of the rear saddle member 6 are each in the form of a spiral turn 12*a*, 12*b* and 12*c*, 12*d*, respectively. For better connection to the ends 4*a*, 4*b* and 6*a*, 6*b*, the seat surface 2 or the covering 8 is mounted in said spiral turns 12*a*-12*d* by winding. According to a preferred embodiment, a covering guide 13*a*, 13*b*, around which the covering 8 is wound, runs between the ends 4*a*, 6*a* and 4*b*, 6*b*, which are located opposite one another in the peripheral regions 9*a*, 9*b* of the covering 8. Such a covering guide 13*a*, 13*b* is preferably configured as a flexible rod and is adhesively bonded or welded or sewn to the covering 8. According to a further variant, the covering guide is formed by the covering itself, in particular by a wound and adhesively bonded or welded region of the same.

The piece of seating furniture 1 comprises a rolling framework 14, which carries the saddle support 3. In specific terms, the rolling framework 14 comprises a front extension arm 15, with a front roller 16, and two rear extension arms 17*a*, 17*b*, with rear rollers 18*a*, 18*b*. The angles $\alpha$1 and $\alpha$2 between the front extension arm 15 and rear extension arm 17*a* and the front extension arm 15 and rear extension arm 17*b*, respectively, are each greater than 120°—as can be seen from FIG. 4, It can be seen, in particular, from FIGS. 5 and 10 that the front member support 5 and the rear member support 7 form a carrier T. The saddle S here comprises said carrier T, the front saddle member 4, the rear saddle member 6 and the seat surface 2, which is formed as a covering 8. The front saddle member 4 is arranged at a front end T1 of the carrier T and the rear saddle member 6 is arranged at rear ends T2, T3 of the two-armed member support 7 of the carrier T. The front saddle member 4 and the rear saddle member 6 are thus spaced apart from one another such that they are located opposite one another with no contact. The covering 8 is fastened on the oppositely located saddle members 4, 6 such that the covering 8, subjected to tensile stressing, forms the seat surface 2, wherein the seat surface 2 is curved convexly in the direction of a user's bottom, and wherein the covering 8 is elastically expansible and designed, and tensioned, such that it is suitable, when subjected to elastic deformation as a seat surface 2, to carry the user. The saddle S is carried by the saddle support 3, which is designed as a height-adjustable spring element and is retained by the rolling framework 14. The saddle support 3 connects the rolling framework 14 in a rotationally fixed manner to the saddle S, in order to ensure constant alignment of the extension arms 15, 17*a* and 17*b* with the saddle surface 2. The carrier T of the saddle S and the extension arms 15, 17*a* and 17*b* of the rolling framework 14—as seen in a vertical view from above of the piece of seating furniture 1—are both formed in the same Y-shaped orientation, as can be seen from FIG. 4.

The seat surface 2, as shown in FIGS. 3 and 4, is defined at a front portion AF, by way of the progression of the front saddle member 4, with a height h4, as measured vertically upward from a reference plane RP running parallel to an underlying surface G, and a width b4, as measured parallel to the reference plane RP, and at a rear portion AR, by way of the progression of the rear saddle member 6, with a height h6, as measured vertically upward from the reference plane RP, and a width b6, as measured parallel to the reference plane RP. For the piece of seating furniture 1 shown here, h4>h6 and b6>b4. The widths b4, b6 of the saddle members 4, 6 are measured horizontally in space and at right angles to a longitudinal axis L1 of the piece of seating furniture 1, said axis being defined by the front member support 5 and being located horizontally in space. Observing said dimensional relationships gives the seat surface a three-dimensional shape which meets the basic anatomical requirements. In principle, the highest point HP4 of the front saddle member 4 has a difference in height H46, as measured vertically in space, in relation to the highest point HP6 of the rear saddle member 6, wherein the highest point HP4 of the front saddle member 4 is located at a higher level than the highest point HP6 of the rear saddle member 6.

A curvature of the seat surface 2 which is suitable for the user is also achieved in that—as shown in FIGS. 5 and 8—the front saddle member 4 is curved to a more pronounced extent than the rear saddle member 6 and a fastening region BS4 of the front saddle member 4 has a length L4 which corresponds to a length L6 of a fastening region BS6 of the rear saddle member 6. A fastening region here is understood to mean that region of the fastening member on which the covering is fastened. In the case of the piece of seating furniture 1 illustrated, the two fastening regions are designed in the form of strips. In the case of such dimensioning of the lengths L4 and L6 of the fastening regions BS4 and BS6 of the saddle members 4 and 6, the blank of the covering 8, which forms the seat surface 2, is in the form of a rectangle. The covering, in the form of a woven fabric, is thus easy to process as far as finishing off the edges is concerned since, in the case of a woven fabric which is produced with a width corresponding to the length L4 or L6, there is no damage to the woven fabric in the region of the woof threads as a result of the fabric being cut to size. The rectangular blank for the covering 8 then has the dimensions L4×L9*b*.

Figure 7:
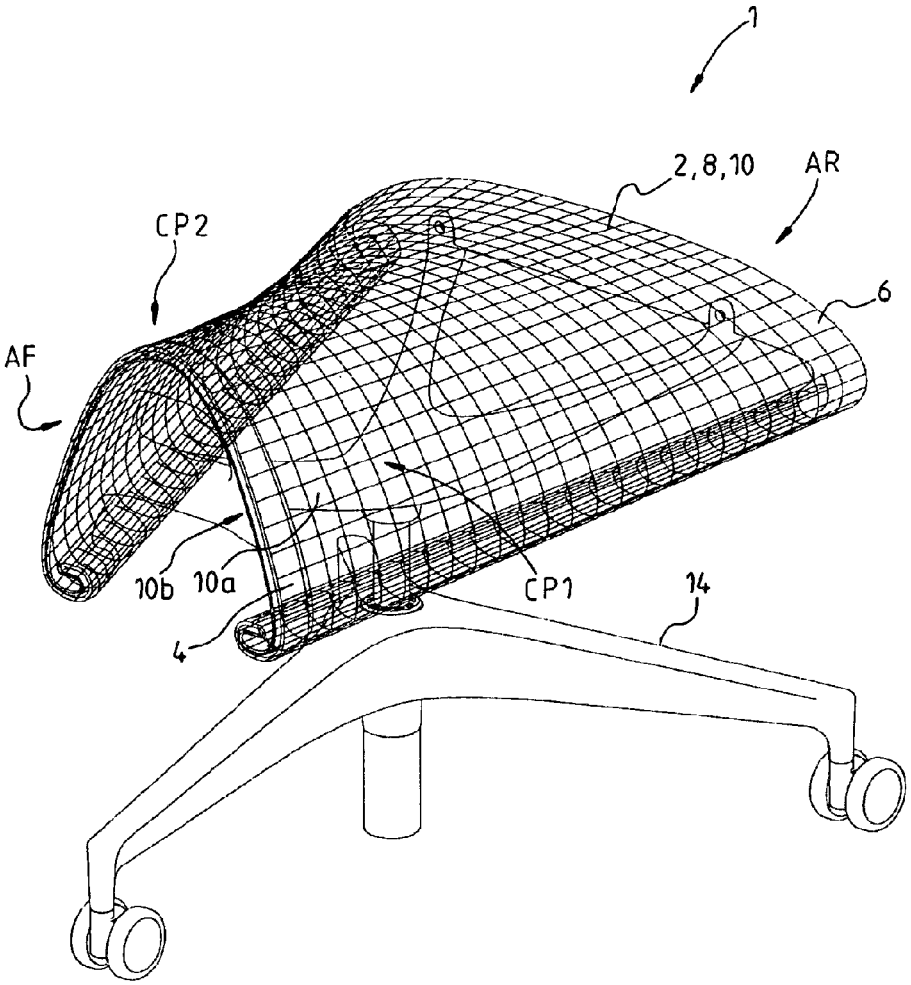
FIG. 7 shows a further perspective view of the piece of seating furniture shown in FIG. 1, this time with the visible surface illustrated as a mesh.

It can be seen in particular in FIG. 7, in which the covering 8, which forms the seat surface 2, is illustrated schematically as a mesh, that the seat surface 2, proceeding from a front portion AF to a rear portion AR, has a continuously decreasing convex curvature and also, as can be seen from FIG. 3, slopes down, towards its rear portion AR, in the direction of an underlying surface, on which the piece of seating furniture 1 is standing. This shaping is the result of the front saddle member 4 and the rear saddle member 6 being curved to differently pronounced extents, wherein the rear saddle member 6 has a saddle-member height SH6, which is less than half a saddle-member height SH4 of the front saddle member 4. This means that a user, who sits on the piece of seating furniture 1 such that he is looking in arrow direction x, is provided with two large bearing surfaces CP1 and CP2 for those regions of the insides of his thighs which are in the vicinity of his knees, these bearing surfaces making it possible for the user to move the piece of seating furniture 1 to the left or right by applying pressure using a thigh, without this resulting in the user feeling an uncomfortable pressure point. The rear saddle member 6 here is aligned with the front saddle member 4 such that, as seen in the side view of FIG. 3, a lower edge K61 of the rear saddle member 6 is located at a higher level above the underlying surface G than a lower edge K41 of the front saddle member 4, and that, as seen in the side view of FIG. 3, an upper edge K62 of the rear saddle member 6 is located beneath an upper edge K42 of the front saddle member.

Figure 11:
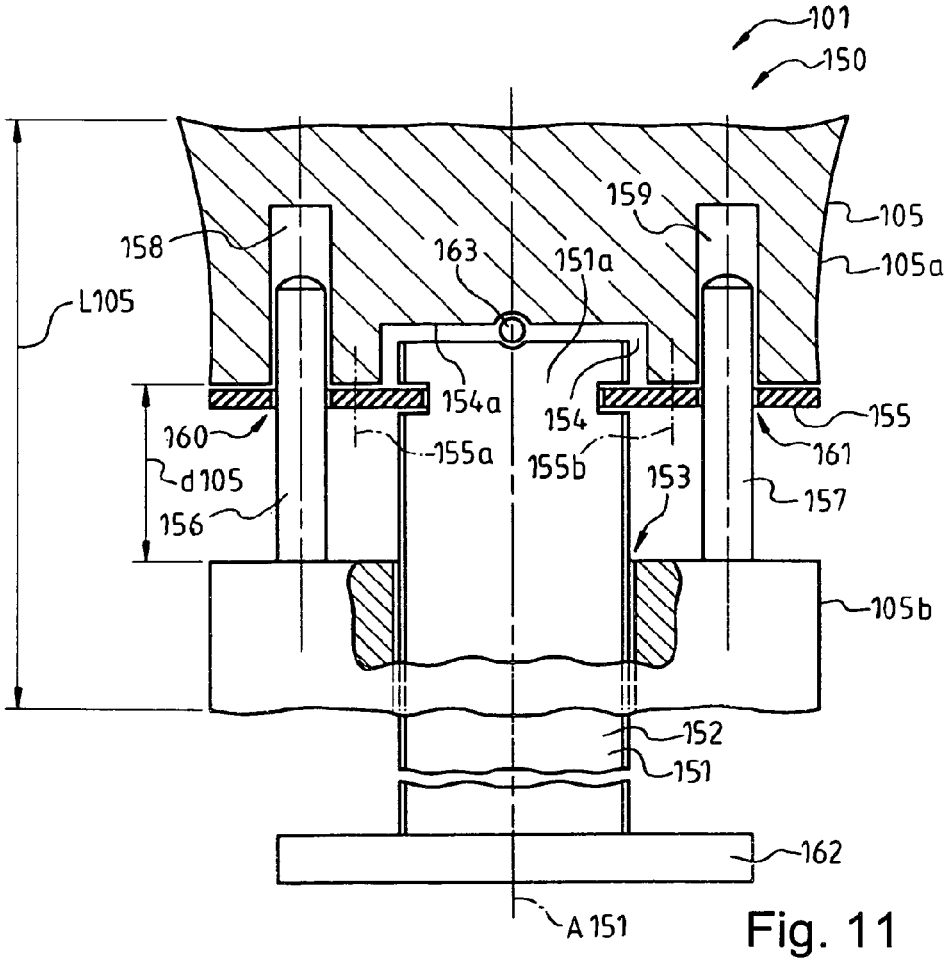
FIG. 11 shows a variant of the piece of seating furniture according to the invention having a tensioning device.

FIG. 11 shows a detail of a second piece of seating furniture 101 in the region of a tensioning device 150. The piece of seating furniture 101 is of comparable configuration to the piece of seating furniture 1, which is shown in FIGS. 1 to 10. In contrast to the latter, the tensioning device 150 is integrated in a front member support 105, part of which is shown in FIG. 11. It is thus possible to change the length L105 of the member support 105, and thus also to change a distance between a front saddle member (not shown) and a rear saddle member (not shown). The front member support 105 is subdivided into a fixed, first portion 105*a*, which is connected to a rear member support (not illustrated), and a displaceable, second portion 105*b*, wherein the second portion 105*b* carries the front saddle member 4 (not illustrated). The tensioning device 150 comprises a spindle 151 with an external thread 152, wherein the spindle 151 is guided in a threaded bore 153 which passes through the second portion 105*b*. The spindle 151 extends, by way of a mushroom-shaped continuation 151*a*, into a blind hole 154, which is made in the first portion 105*a*, and it is fixed therein by a retaining plate 155, wherein the retaining plate 155 is connected to the first portion 105*a* of the saddle member 105 by schematically indicated fastening means 155*a* and 155*b*. Furthermore, the second portion 105*b* of the member support 105 is guided on the first portion 105*a* of the member support 105 by means of two pins 156, 157. The pins 156, 157 here are fixed to the second portion 105*b* of the member support 105 and are guided in bores 158, 159 of the first portion 105*a*, wherein the retaining plate 155 has through-holes 160, 161 in the region of the bores 158, 159. Rotation of the spindle 151, using a hand wheel 162, about a spindle axis A151, makes it possible to increase a distance d105 between the two portions 105*a* and 105*b* of the split member support 105, and to tension a covering (not illustrated) of the piece of seating furniture 101, or to decrease the distance d105, and to reduce tensioning of the covering (not illustrated) of the piece of seating furniture 101. In order to ensure smooth running of the spindle 151 on a permanent basis, a ball 163 is arranged between the spindle 151 and a floor 154*a* of the blind hole 154. The tensioning device makes it possible for the user, by way of tensioning the covering or relieving the tensioning from the same, to adapt the extent of elastic deformation manifested by the covering under loading to his individual requirements and/or to his body weight.

Figure 12:
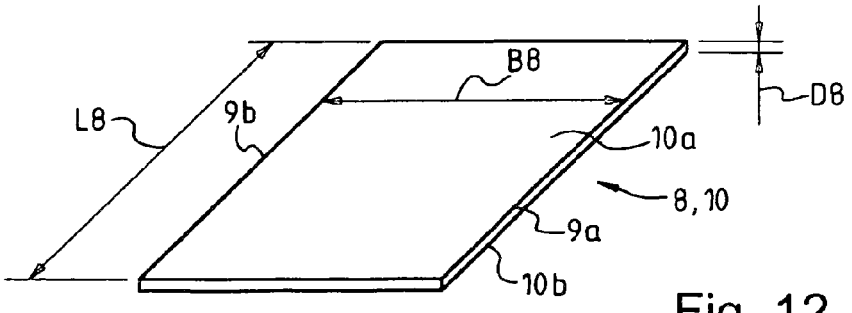
FIG. 12 shows a schematic, perspective view of the spread-flat covering of the piece of seating furniture shown in FIGS. 1 to 10.

The covering 8 of the piece of seating furniture shown in FIGS. 1 to 10 is illustrated in a perspective view and a laid-flat state in FIG. 12. The covering 8, as already mentioned, is configured as a woven mesh fabric 10 and is of equal thickness D8 between its upper side 10*a* and its underside 10*b*. With a width B8 and a length L8, the covering 8 is designed in the form of a rectangular blank. The width B8 here corresponds to the length L4, L6 of the fastening region BS4, BS6, respectively. The length L8 of the covering 8 corresponds to the length of the connecting edge 9*a*, 9*b*. The width B8, in a variant of the piece of seating furniture, has a value between 60 cm and 90 cm and, in a preferred embodiment, has a value between 72 cm and 82 cm. The length L8, in the case of such a width B8, has a value between 30 cm and 70 cm and, in a preferred embodiment, has a value between 40 cm and 60 cm.

Figure 13:
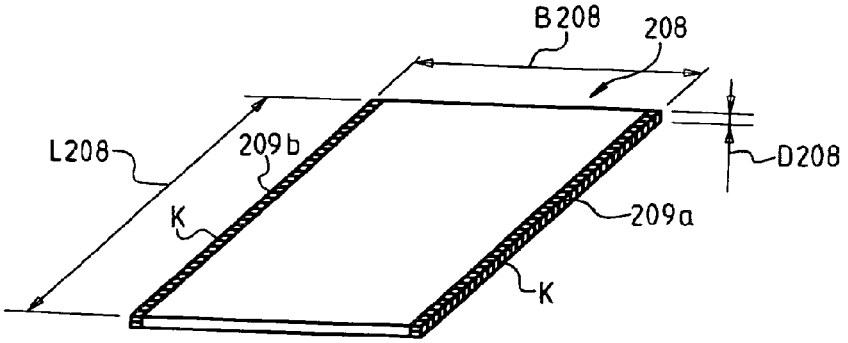
FIGS. 13 and 14 show variants of the covering shown in FIG. 12.

FIG. 13 illustrates a variant of the covering 8 shown in FIG. 12. In respect of its dimensions B208, L208 and D208, the covering 208 is configured in the same way as the covering 8 shown in FIG. 12. In contrast to the latter, connecting edges 209*a*, 209*b* of the covering 208 are encapsulated in a plastics material K, in order to avoid fraying of the connecting edges 209*a* and 209*b*.

Figure 14:
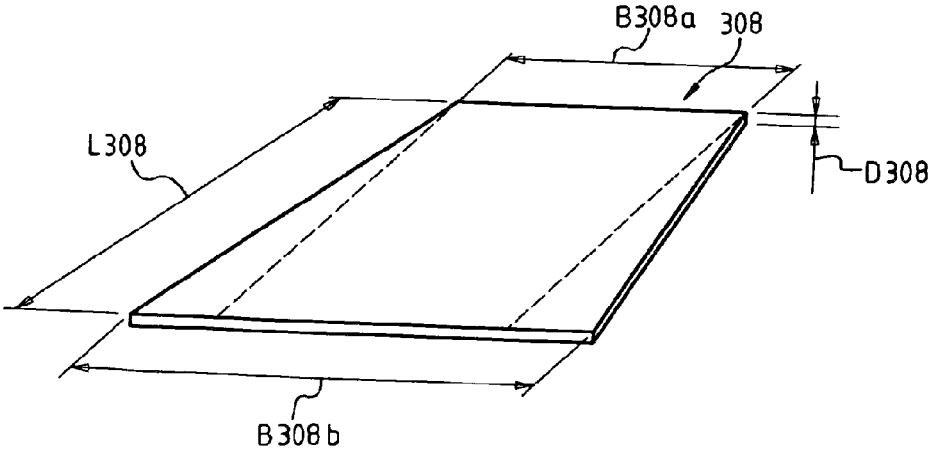

FIG. 14 illustrates a further variant of the covering 8 shown in FIG. 12. The covering 308, in contrast to the covering 8, is in the form of an isosceles trapezoid, rather than a rectangle, when seen in the planar state in plan view. The bases are of different length B308*a* and B308*b* and the legs are of equal length L308. As far as the thickness D308 is concerned, the covering 308 is configured in a manner corresponding to the covering 8 shown in FIG. 12. Such a covering 308 is used in pieces of seating furniture of which the saddle members have fastening regions of different lengths. FIG. 14 uses dashed lines to indicate the shape of the covering 8 shown in FIG. 12.

Figure 15:
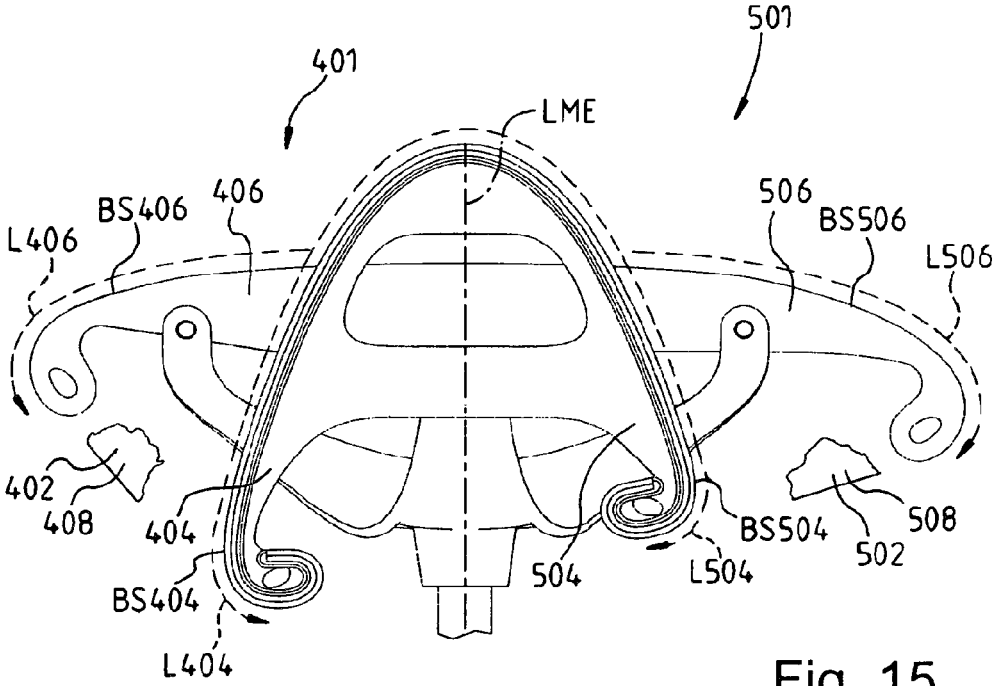
FIG. 15 shows an illustration of two further variants of a piece of seating furniture according to the invention.

According to two variants illustrated in FIG. 15, the invention provides for the lengths of the fastening regions of the saddle members to be dimensioned differently. Optionally a rectangular blank or a trapezoidal blank is then used for covering purposes. A rectangular blank, when fastened in the region of the saddle member with the greater fastening-region length, is then expanded to a more pronounced extent than in the region of the saddle member with the shorter fastening-region length. A trapezoidal blank, as is shown in FIG. 14, then has its shorter base fastened on the saddle member with the shorter fastening-region length and its longer base fastened on the saddle member with the greater fastening-region length, provision preferably being made for the converging edges of the trapezoidal blank, or of the trapezoidal covering, to be encapsulated, in order for the edges to be stabilized, as is shown in FIG. 13 for a rectangular blank. FIG. 15 illustrates, to the left of a longitudinal center plane LME, a detail of a piece of seating furniture 401 which has a rear saddle member 406 which has a fastening region BS406 which, having a length L406, is of shorter configuration than a fastening region BS404 of a front saddle member 404, the latter fastening region having a length L404. FIG. 15 illustrates, to the right of the longitudinal center plane LME, a detail of a piece of seating furniture 501 which has a rear saddle member 506 which has a fastening region BS506 which, having a length L506, is of longer configuration than a fastening region BS504 of a front saddle member 504, said latter fastening region having a length L504. Such variations of the saddle members and/or of the fastening lengths of the saddle members make it possible for the piece of seating furniture to be adapted to users of very different builds and to a wide variety of different use purposes. In the case of the two pieces of seating furniture 401 and 501 which are shown in FIG. 15, a respective covering 408, 508, which forms a respective seat surface 402, 502, is indicated merely in detail form. The two pieces of seating furniture also comprise a rolling framework as is shown in FIG. 1 ff.

LIST OF DESIGNATIONS

1 Piece of seating furniture
2 Seat surface
3 Saddle support
4 Front saddle member
4*a* First end of 4
4*b* Second end of 4
5 Front member support
6 Rear saddle member
6*a* First end of 6
6*b* Second end of 6
7 Rear member support
8 Covering
9*a*, 9*b* Connecting edge
10 Woven mesh fabric
10*a*, 10*b* Upper side and underside, respectively, of 10
11 Free
12*a*-12*d* Spiral turn
13*a*, 13*b* Covering guide
14 Rolling framework
15 Front extension arm of 14
16 Front roller on 15
17*a*, 17*b* Rear extension arm of 14
18*a*, 18*b* Rear roller of 17*a* and 17*b*, respectively
101 Second piece of seating furniture
105 Front member support
105*a* First portion of 105
105*b* Second portion of 105
150 Tensioning device
151 Spindle
151*a* Continuation of 151
152 External thread of 151
153 Threaded bore in 105*b*
154 Blind hole in 105*a*
154*a* Floor of 154
155 Retaining plate 155
155*a*, 155*b* Fastening means
156, 157 Pin on 105*b*
158, 159 Bore in 105*a*
160, 161 Through-hole in 155
162 Hand wheel of 151
163 Ball
208 Covering
209*a*, 209*b* Connecting edge on 208
308 Covering
401 Piece of seating furniture
402 Seat surface
404 Front saddle member of 401
406 Rear saddle member of 401
408 Covering
501 Piece of seating furniture
502 Seat surface
504 Front saddle member of 501
506 Rear saddle member of 501
508 Covering
α1, α1 Angle between 15 and 17*a* and between 15 and 17*b*
A151 Spindle axis
AF Front portion of 2

AR Rear portion of 2
B8 Width of 8
B208 Width of 208
B308*a*, B308*b* Width of 308
BS4, BS6 Fastening region on 4 and 6, respectively
BS404, BS406 Fastening region on 404 and 406, respectively
BS504, BS506 Fastening region on 504 and 506, respectively
b4 Width of 4
b6 Width of 6
CP1, CP2 Bearing surface on 2 and/or 8
D8 Thickness of 8
D208 Thickness of 208
D308 Thickness of 308
d105 Distance between 105*a* and 105*b*
G Underlying surface
HP4 Highest point of 4
HP6 Highest point of 6
H46 Difference in height between HP4 and HP6
h4 Height of 4
h6 Height of 6
K Plastics material
K41, K42 Lower edge and upper edge, respectively, of 4
K61, K62 Lower edge and upper edge, respectively, of 6
L1 Longitudinal axis of 1 and 5
L4 Length of BS4
L6 Length of BS6
L8 Length of 8
L9*b* Length of L9*b*
L105 Length of 105
L208 Length of 208
L308 Length of 308
L404, L406 Length of BS404 and BS406, respectively
L504, L506 Length of BS504 and BS506, respectively
LME Longitudinal center plane
R2 All-round peripheral region of 2
RP Reference plane
S Saddle
SH4, SH6 Saddle-member height of 4 and 6, respectively
T Carrier
T1 Front end of 5
T2, T3 Rear end of 5

The invention claimed is:

1. A piece of seating furniture comprising:

a saddle-form seat surface, wherein the seat surface is arranged on a saddle support, the seat surface mounted between a front saddle member on a front member support and a rear saddle member on a rear member support, wherein the front and rear saddle members are spaced apart to define an opening therebetween, and wherein the seat surface is defined by a covering extending across the opening between the saddle members, wherein the covering is connected to the front saddle member between a first end of the front saddle member and a second end of the front saddle member in a continuous and opening-free manner along a first fastening region, wherein the covering is connected to the rear saddle member between a first end of the rear saddle member and a second end of the rear saddle member in a continuous and opening-free manner along a second fastening region, and wherein the first fastening region follows a curved, convex progression of the front saddle member and has a first length and wherein the second fastening region follows a curved, convex progression of the rear saddle member and has a second length.

2. The piece of seating furniture as claimed in claim 1, wherein the first length of the first fastening region is equal to the second length of the second fastening region.

3. The piece of seating furniture as claimed in claim 1, wherein the first length of the first fastening region is greater than the second length of the second fastening region.

4. The piece of seating furniture as claimed in claim 1, wherein the second length of the second fastening region is greater than the first length of the first fastening region.

5. The piece of seating furniture as claimed in claim 1, wherein the seat surface is mounted in a self-supporting manner between the saddle members.

6. The piece of seating furniture as claimed in claim 1, wherein the covering is formed by a woven mesh fabric.

7. The piece of seating furniture as claimed in claim 1, wherein the front support member and the rear support member form a carrier, wherein a saddle comprises the carrier, the front saddle member, the rear saddle member and the seat surface, wherein the seat surface comprises a covering, wherein the front saddle member is arranged at a front end of the carrier, wherein the rear saddle member is arranged at rear ends of the carrier, wherein the front saddle member and the rear saddle member are spaced apart from one another such that they are located opposite one another with no contact, wherein the covering is fastened on the oppositely located front and rear saddle members such that the covering, subjected to tensile stressing, forms the seat surface, wherein the seat surface is curved convexly, and wherein the covering is elastically expansible and tensioned between the front and rear saddle member, wherein the covering is elastically deformable when subjected to a load from a user seated thereon.

8. The piece of seating furniture as claimed in claim 1, wherein the covering has a thickness of not more than 3 mm.

9. The piece of seating furniture as claimed in claim 1, wherein the front saddle member and the rear saddle member are moveable relative to one another, wherein a distance between the two can be changed via a tensioning device.

10. The piece of seating furniture as claimed in claim 1, wherein the seat surface is defined at a front portion with a height (h4) and a width (b4) and at a rear portion with a height (h6) and a width (b6), wherein h4>h6 and b6>b4.

11. The piece of seating furniture as claimed in claim 1, wherein the saddle support is arranged on a rolling framework, wherein the rolling framework comprises a front extension arm having a front roller, and two rear extension arms each comprising a rear roller, wherein an angle of greater than 120° is formed between the front extension arm and each of the rear extension arms.

12. The piece of seating furniture as claimed in claim 11, wherein a progression of the front and rear member support members, as seen in vertical projection, corresponds to a progression of the front and rear extension arms respectively.

13. The piece of seating furniture as claimed in claim 1, wherein the seat surface is fixed at the saddle members and flexible between the saddle members.

14. The piece of seating furniture as claimed in claim 13, wherein connecting edges of the seat surface extending between the front and rear saddle members are flexible and deformable.

15. A piece of seating furniture comprising:

a saddle-form seat surface, wherein the seat surface is arranged on a saddle support, the seat surface mounted between a front saddle member on a front member support and a rear saddle member on a rear member support, wherein the front and rear saddle members are spaced apart to define an opening therebetween, and wherein the seat surface is defined by covering extending across the opening between the saddle members, wherein the covering is connected to the front saddle member between a first end of the front saddle member and a second end of the front saddle member in a continuous and opening-free manner along a first fastening region, wherein the covering is connected to the rear saddle member between a first end of the rear saddle member and a second end of the rear saddle member in a continuous and opening-free manner along a second fastening region, and wherein the first and second ends of each of the front saddle member and the rear saddle member have a spiral turn in which the seat surface is mounted.

* * * * *